United States Patent [19]

Vidmar et al.

[11] Patent Number: 5,028,928

[45] Date of Patent: Jul. 2, 1991

[54] ULTRA-STABLE, STRESSED-SKIN INFLATABLE TARGET SUPPORT SYSTEMS

[76] Inventors: Robert J. Vidmar, P.O. Box 2207, Stanford, Calif. 94309; David G. Watters, 1192 East Vanderbilt Ct., Sunnyvale, Calif. 94087

[21] Appl. No.: 543,987

[22] Filed: Jun. 26, 1990

[51] Int. Cl.[5] ..... H01Q 15/00; H01Q 17/00

[52] U.S. Cl. ..... 342/10; 342/4; 342/165

[58] Field of Search ..... 342/10, 1, 4, 165

[56] References Cited

U.S. PATENT DOCUMENTS

| | | | |
|---|---|---|---|
| 3,115,630 | 12/1963 | Lanford | 342/10 |
| 3,217,325 | 11/1965 | Mullin | 343/18 |
| 3,276,017 | 9/1966 | Mullin | 343/18 |
| 3,289,205 | 11/1966 | Kampinsky | 342/169 |
| 3,778,837 | 12/1973 | Hardy | 342/1 X |
| 4,514,447 | 4/1985 | Boymeyer | 428/36 |
| 4,540,987 | 9/1985 | Werkes et al. | 342/10 |
| 4,713,667 | 12/1987 | Poirier et al. | 343/192 |
| 4,879,560 | 11/1989 | McHenry | 342/165 |
| 4,901,080 | 2/1990 | McHenry | 342/1 |

*Primary Examiner*—John B. Sotomayor
*Attorney, Agent, or Firm*—John Y. Chen

[57] ABSTRACT

An inflatable target support system having a minimum radar cross section, a high mechanical strength, an ultra-high rigidity and a high load bearing capacity. The system comprises a thin, inflatable, stressed-skin membrane in the shape of a right cone which is sealed at its narrow end by a extremely rigid, plug and sealed at its wide end by a chamfer shaped base so as to provide exceptional rigidity to the system.

4 Claims, 7 Drawing Sheets

ULTRA-STABLE, STRESSED-SKIN INFLATABLE TARGET SUPPORT SYSTEMS

BACKGROUND OF THE INVENTION

This invention is related to stressed-skin inflatable support systems which are exceptionally stable under axial and transverse loading conditions. The inflatable support systems of the invention are particularly useful as target supports for radar cross section (RCS) measurements.

Although various papers have appeared which are concerned with the stability of thin-skin shells, none are considered very well suited for supporting heavy loads or as radar target supports providing a low radar cross section suitable for radar scattering measurements.

For example: Weingarten, V. I., in his paper "Stability of Internally Pressurized Conical Shells under Torsion", AIAA Journal, Vol. 2, No. 10, pp. 1782–1788, October 1964, describes experiments with pressurized Mylar® conical shells to determine the effect of internal pressure on the buckling stress of such shells under torsion. Weingarten found: "It is evident that there is a large scatter band for the cone data, the average being about 88% of the theoretical value with the extremes ranging from 67 to 122% of the theoretical value." His experiments showed: ". . . yielding of the cone material near the small end as the pressure was increased." and went on to further state: "The quantitative agreement between Eq. (3) and the experimental results is poor, however, for conical shells . . . ".

In a later paper by Weingarten, V. I., et al, titled: "Elastic Stability of Thin-Walled Cylindrical and Conical Shells under Combined Internal Pressure and Axial Compression", AIAA Journal, Vol. 3, No. 6, AIAA Journal, pp. 118–1125, June 1965, the authors describe tests on pressurized cylinders and cones constructed of Mylar® under internal pressure and axial compression. The results indicated that the end-support and sealing methods were the main causes of failure (i.e., deformations appeared, buckles developed, and the onset of plasticity) which develop at or near the ends. As stated in their paper: "The scatter appeared to be dependent upon the end conditions, among other factors, since the two casting materials used, Cerrobend® and Cerrolow®, gave consistently different results."

The earliest known paper on inflatables as target support for radar cross section (RCS) measurements is a report by Senior, T. B. A., et al, entitled: "Radar cross section target supports-Plastic materials", Rome Air Development Center, Griffiss Air Force Base Technical Documentary Report No. RADC-TDR-64-381 (Rome Report), June 1964. The report describes structural analysis and technical considerations of air bag target supports of various shapes, such as a simple truncated cone, a double truncated cone, and a cone cylinder combination. The simple conical shape was considered to be the most practical. "It was also recognized that the top of such a support will tend to balloon out into a hemispherical shape, which may pose mounting problems for certain types of targets. The ballooning can be overcome by properly designed Styrofoam® saddles, which will provide the necessary stability and attitude control."

A truncated cone, ". . . 16 feet in diameter and 30 feet high, fabricated from neoprene coated nylon with sewn seams was tested. It proved to be very stable, moved less than six inches in a forty knot wind. The support was inflated to a pressure of 0.25 psi. It was used to elevate a 150 pound target. Its theoretical capacity at the inflated pressure was estimated to be 250 pounds."

As stated in the Rome Report, ". . . the investigation of (1) Styrofoam structural properties, (2) low cross section structural bonds, and (3) the feasibility of air-inflated target supports. These investigations were not completed due to diversion of contract funds to more promising R & D areas."

The following year, Freeny, C. C., in his paper "Target Support Parameters Associated with Radar Reflectivity Measurements", Proceedings of the IEEE, Vol. 53, pp. 929–936, 1965 mentions the Rome Report. Sixteen years later, the only structures mentioned as useful to support targets for radar measurements (mentioned in "Radar Cross Section Handbook", by Ruck, George T; et al, Plenum Press, New York, pp. 915–923, 1970) were cellular plastic columns or dielectric suspension lines. Eighteen years later, Bachman, C. G., in his book titled "Radar targets", Lexington Books, Lexington, Mass.: D. C. Heath and Company, page 123, 1982 describes conventional methods of supporting targets such as polyfoam, steel column, and rope or string and inflatables as exotic and useful for supporting small targets. Twenty five years later, Knott, E. F., (in Chapter 9 on Far Field RCS Test Ranges of Nicholas Currie's book titled "Radar Reflectivity Measurement: Techniques & Applications", Artech House, Inc., Norwood, Mass., pp. 307–367, 1989) mentions three standard methods of supporting targets exposed to instrumentation radars for RCS measurements: plastic foam columns, strings, and absorber-coated metal pylons.

SUMMARY OF THE INVENTION

The present invention advances the art of radar cross section (RCS) measurements of targets by providing an essentially inflatable target supporting method and a target supporting system having a minimum RCS, high mechanical strength, ultra-high rigidity, and high load bearing capacity. An inflatable target support system is provided which comprises a preselected high strength, low dielectric, stressed-skin membrane forming a curved surface of a frustum of a right cone having a preselected base radius and a preselected top radius which cone is sealed at the top radius by a preselected rigid (shrinkable-film encapsulated) top plug and sealed at the base radius by a preselected chamfer (shaped) base; said plug having a predetermined shape including a height, a radius, and a side taper angle; said taper angle of said plug being greater than said angle of said right; cone and said plug height being approximately equal to said plug radius; said chamfer base having a predetermined diameter which is greater than said right cone base radius. In conforming, sealing, and securing the base radius of the stressed-skin membrane to the chamfer base, the stressed-skin is first prestressed to accept the chamfer base and then sealed and secured to the chamfer base by an assembly of sealing and securing means, such as band(s), ring(s), screw(s), adhesive layer(s), O-ring(s), and the like. The preselected stress-skin membrane, when assembled together with said plug and said chamfer base and inflated, will provide a substantially fold-free, stable, and exceptionally rigid support for any predetermined load.

The novel features which are believed to be characteristic of the invention are set forth with particularity in the appended claims. The invention itself, however, both as to its organization and method of operation, together with further objects and advantages thereof, may best be understood by reference to the following description taken in connection with the accompanying drawings.

DESCRIPTION OF PREFERRED EMBODIMENTS

Figure 7:
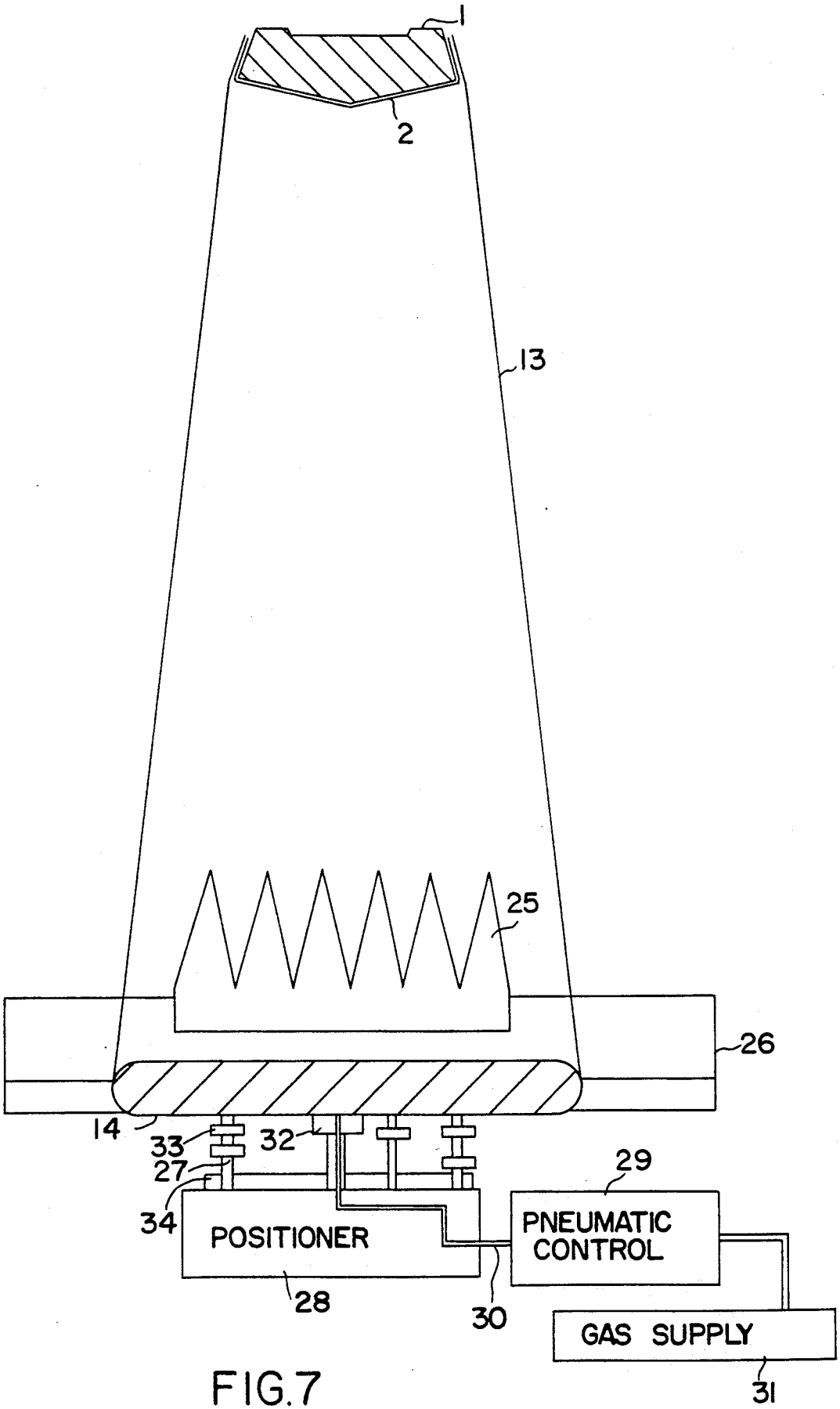
FIG. 7 is a general sectional view of the target support system including the encapsulated top plug, inflated stressed-skin, base absorber, radio frequency gasket, positioner, pneumatic lines, rotary joint, and pneumatic control, gas supply.

The invention is illustrated and described here in its most exacting application, viz., as a support for a target for RCS measurements. The inflatable target support system is illustrated in FIG. 7, sealed at the top with a shrinkable-film 2 encapsulated top plug 1 in a fully seated position against the inflated stressed-skin membrane of the right cone 13 and sealed at the bottom by a chamfer (shaped) base 14 (not illustrated in detail here). The right cone 13 contains within its bottom circumference a Radio Frequency (RF) absorber 25 resting on the chamfer base 14 surrounded by a Radio Frequency (RF) gasket 26 which snugly fits over the chamfer base 14. The RF gasket 26 comprises two parts, one part is contained within the right cone and an outer part which is resting on the outside circumference of the right cone. FIG. 7 also shows a conventional positioner 28 and pneumatic control 29, gas supply 31 and pneumatic line 30, and a pneumatic rotary joint 32.

We have published various embodiments of our invention which can be found in: Watters, D., et al, "Stressed-Skin Target Supports for RCS Measurements," 1989 URSI, Radio Science Meeting, International Union of Radio Science, San Jose, Calif., 26–30 June 1989; Watters, D., et al, "Inflatable Target Support for RCS Measurements," AMTA Proceedings, 11th Annual Meeting and Symposium, 1989, Monterey, Calif., pp. 12–15 to 12–19, 9–13 October 1989; Waters, d., et al, "Design of Inflatable Target Support for RCS Measurement," 1990 URSI Radio Science Meeting, International Union of Radio Science, May 7–11, Dallas Convention Center, Dallas, Tex., p 252, 1990; and "Inflatable Support System", Brochure M-1254-1M-734-9005, ISS-745001 May 1990. The subject matter of these publications is incorporated herein by reference. A copy of the AMTA Proceedings is attached and included in the Appendix.

Below 1 GHz the present invention provides a ITSS of lower RCS than foam supports, and a much lower vertical polarization RCS than an ogive/blade **14*a* and 14*c* support. Above 1 GHz, the RCS of the invention is comparable to that of a foam support but is more rigid, which provides a superior mechanical mount. In addition, the hollow base permits inclusion of broad-band absorber 25 to minimize reflections from the chamfer base 14. The reduced target-to-base interaction above 1 GHz is an improvement with benefit to RCS range calibration and precision RCS measurements. The design considerations that result in the unique characteristics of the top plug 1, stressed-skin 13, and chamfer base 14** are discussed in detail below.

The ITSS of the present invention with a height of 30 ft, 112-in base diameter, 48-in top diameter, made of 10-mil Mylar can support 900 lb, deflect 4 inches in a 40 knot wind, and has a RCS at 425 MHz of −38 dBsm for both horizontal and vertical polarization. An ITSS with a height of 30 ft, 112-in base diameter, 42-in top diameter, made of 5-mil TCK could support 900 lb, deflect 1 inch in a 40 knot wind, and has a RCS at 425 MHz of −41 dBsm for both horizontal and vertical polarization. Similarly, ITSS with a height of 8 ft, 32-in base diameter, 12-in top diameter, made of 2-mil Mylar can support 50 lb and has a RCS below 1 GHz of −50 dBsm; ITSS with a height of 8 ft, 32-in base diameter, 12-in top diameter, made of 5-mil TCK can support 250 lb and has a RCS below 1 GHz of −40 dBsm; ITSS with a height of 8 ft, 60-in base diameter, 36-in top diameter, made of 5-mil TCK can support 1,250 lb and has a RCS below 1 GHz of −40 dBsm; ITSS with a height of 8 ft, 88-in base diameter, 60-in top diameter, made of 5-mil TCK can support 2,000 lb and has a RCS below 1 GHz of −35 dBsm; ITSS with a height of 16 ft, 60-in base diameter, 24-in top diameter, made of 2-mil Mylar can support 90 lb and has a RCS below 1 GHz of −45 dBsm; ITSS with a height of 16 ft, 60-in base diameter, 24-in top diameter, made of 10-mil Mylar can support 450 lb and has a RCS below 1 GHz of −35 dBsm; ITSS with a height of 16 ft, 60-in base diameter, 24-in top diameter, made of 5-mil TCK can support 600 lb and has a RCS below 1 GHz of −40 dBsm; ITSS with a height of 25 ft, 88-in base diameter, 30-in top diameter, made of 5-mil TCK can support 650 lb and has a RCS below 1 GHz of −45 dBsm; ITSS with a height of 30 ft, 112-in base diameter, 42-in top diameter, made of 10-mil Mylar can support 900 lb and has a RCS below 1 GHz of −45 dBsm; and ITSS with a height of 40 ft, 144-in base diameter, 60-in top diameter, made of 5-mil TCK can support 1,250 lb and has a RCS below 1 GHz of −35 dBsm.

The top plug 1 is the interface between the ITSS and the target. The top plug 1 should have sufficient strength to support the target load, withstand the internal pressure of the ITSS, seal the top of the right cone, and provide a rigid termination to the stressed-skin 13. These mechanical requirements can be met for low-RCS broadband design, which requires a minimum of mass. The following characteristics of the ITSS top plug 1, balances mechanical and electrical requirements and are unique aspects of the top plug 1 design.

The top plug 1 fits in the narrow portion of the right cone. The right cone can be fabricated from various skin material such as Mylar®, Kapton®, Teflon®, PBZT®, TCK® (Teflon®-coated-Kevlar®), Kapton/Teflon, Polyester coated Kevlar, and the like. Less suitable skin materials are high density polyethylene, Nylon 6/6, polypropylene, Nylon/glass, elastomers (latex or butyl), silk, and the like. Stress-skin 13 materials selected are either low dielectric constant, high-tensile strength, plastic films or fabrics. Fabrics are of advantage because they provide rip-stop construction, but for minimum thickness design, films are preferred.

Figure 1:
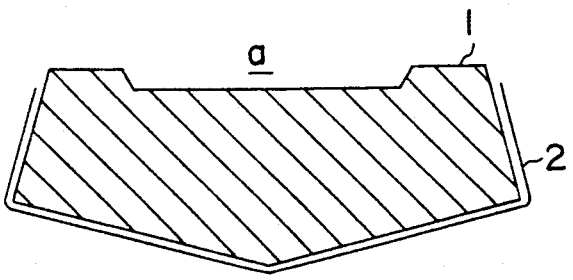
FIG. 1 is a sectional view showing the shrinkable-film encapsulating the top plug.

The sectional view of the top plug 1 in FIG. 1 shows the axis of symmetry and the five sides of the top plug 1. The five sides are the top of the plug, two sides that are at an angle of 90 degrees plus a side taper angle, and two bottom sides that are at an angle of 90 degrees plus a bottom taper angle. The top plug 1 has a load bearing capacity approximately equal to the bottom area of the top plug 1 times the internal pressure of the right cone.

Figure 2A:
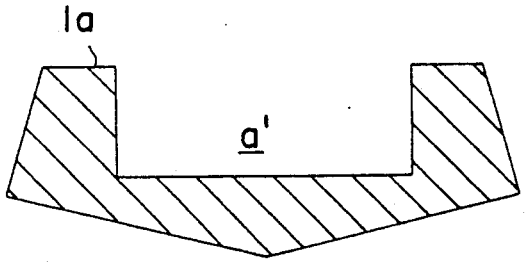
FIGS. 2A–2E are sectional views of representative examples of top plugs.
Figure 2B:
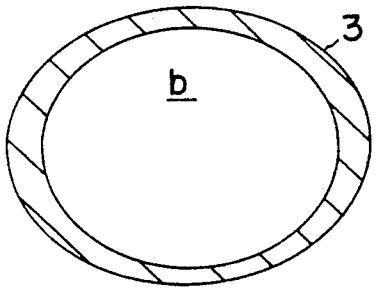
Figure 2C:
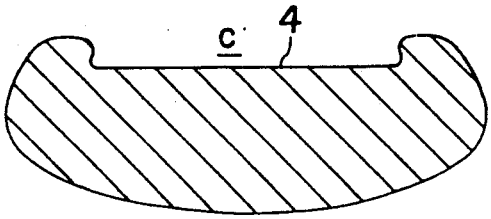
Figure 2D:
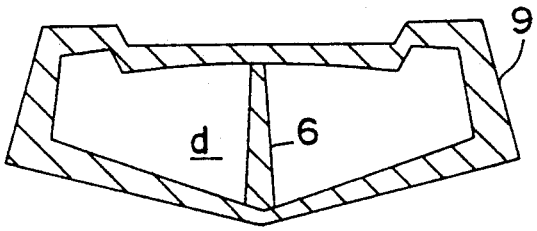
Figure 2E:
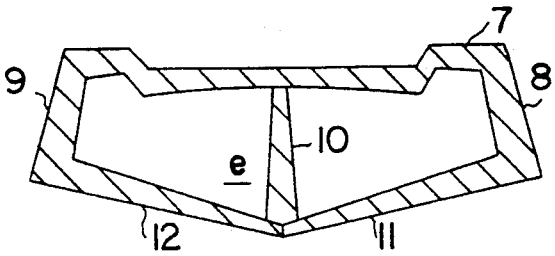
Figure 4D:
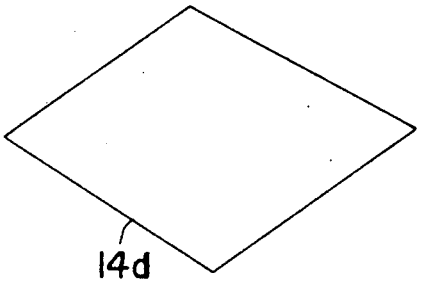
FIGS. 4A–4E are overhead views of various geometries of the base.
Figure 4E:
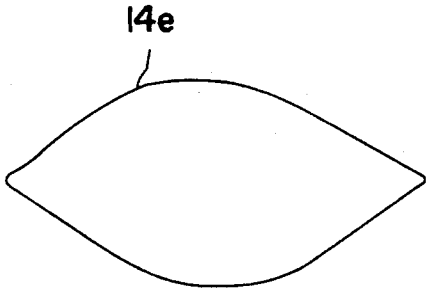
Figure 3:
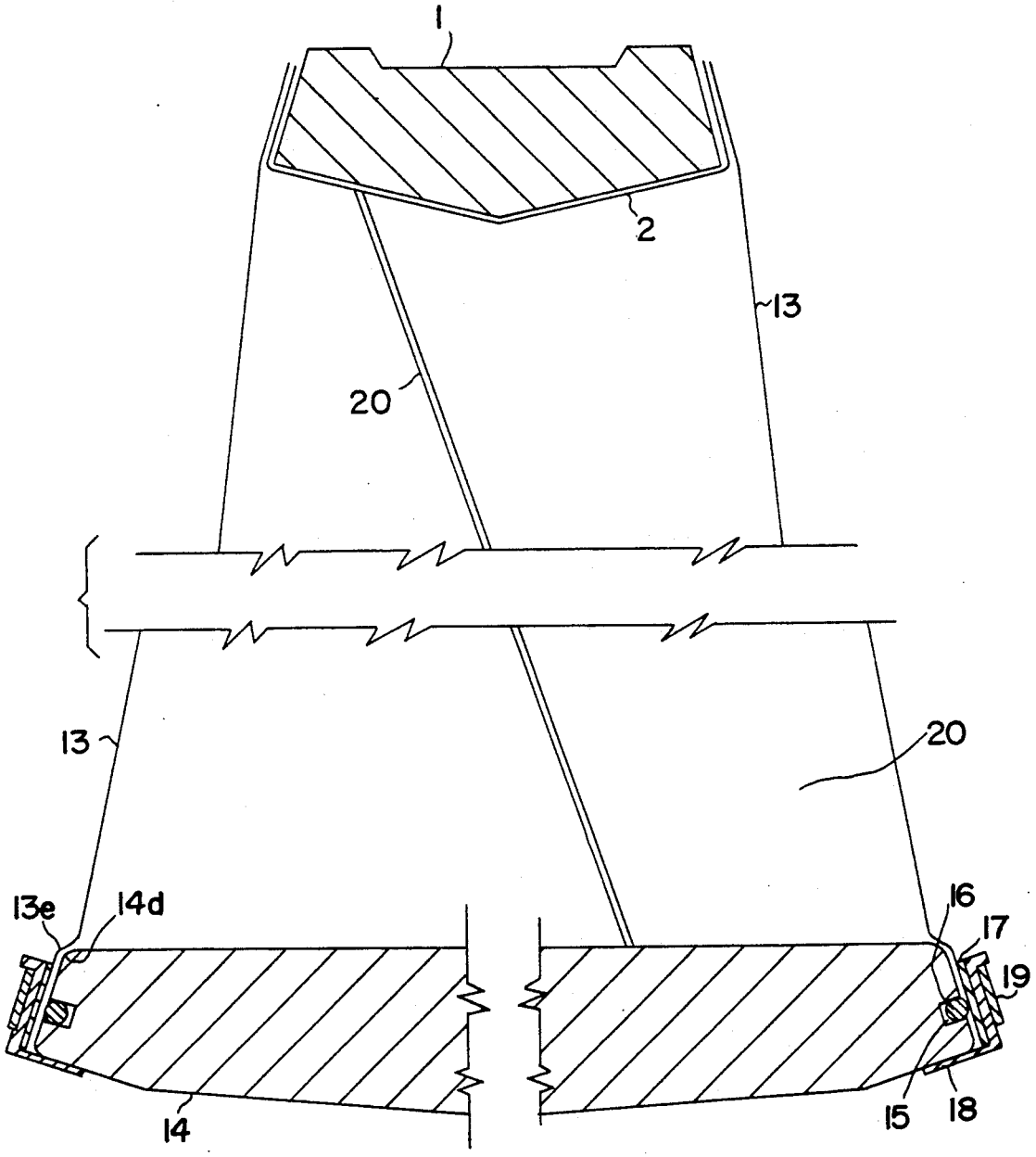
FIG. 3 is a sectional view of the upper target support system including the encapsulated top plug in sealing position on top of the inflated stressed-skin cone and a sectional view of the lower target support system including the inflated stressed-skin attached to the base by clamping means.
Figure 4F:
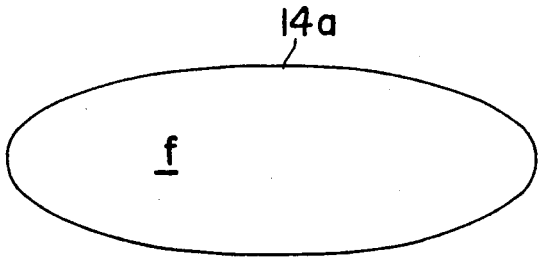
Figure 4G:
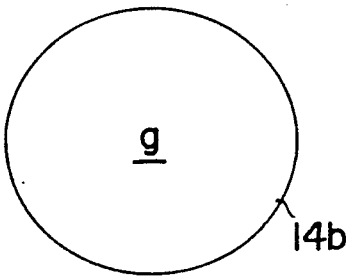
Figure 4H:
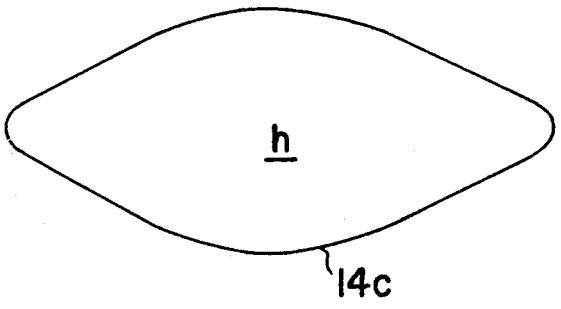

The side taper angle of the top plug 1 is slightly greater than the stressed-skin 13 taper angle so as to create a binding condition when the top plug 1 is forced upward into the right cone, as shown in FIG. 3 and 7. This binding creates a condition of high stress at the bottom of the top plug 1, which compresses the foam. This intentional binding produces a smooth surface of compressed foam at the base of the top plug, which is ideal for a low conductance (small air gap) surface-to-surface seal. A bottom taper angle is chosen to produce an axially symmetric plug with no parallel surfaces. If the top and bottom surfaces of the top plug 1 were parallel, the top plug 1 will act as a dielectric resonator. If any of the sides form a right angle the top plug 1 will act as a corner reflector. Both conditions increase RCS. The top plug 1 design in FIGS. 1, 2*d*, 2*e*, 3, and 7 eliminates the possibility of either condition and assures a low-RCS design.

The stressed-skin 13 taper angle is determined by the chamfer base 14 diameter, height of the right cone, and top plug 1 diameter. The taper angle is selected to provide minimum RCS, and maximum load capacity. Minimum RCS is achieved by redirecting the incident beam away from the receiver, maximum load capacity is determined by internal pressure which is limited by maximum allowable hoop stress at the base of the stress-skin 13 cone, which is proportional to its diameter. A top plug 1 height approximately equal to the top plug radius 1 is necessary for the top plug 1 to be stable to transverse rotation. If the top plug 1 height is approximately one third the top plug 1 diameter, it is possible for it to rotate about a transverse axis and blow out the top of the right cone. Conditions such as a change in temperature can alter the coefficient of friction around the circumference of the top plug 1 and elongation of the stressed-skin 13 material due to thermal expansion can result in movement of the top plug 1 with respect to the stressed-skin 13. If this movement is asymmetric an unstable condition exits. The top plug 1 can rotate upward on a slippery surface and subsequently blow out the top. The shape of the top plug 1 in FIG. 3 has a total perimeter that is slightly less than the circumference of the stressed-skin 13 at the top of the right cone. This permits insertion and extraction from the top of the right cone but rotation of the top plug 1 at the top of the right cone is mechanically prohibited. Depending on the exact taper angles chosen, a plug height of approximately the top plug 1 radius assures a tight seal and rotational stability. A top plug 1 of greater height would be more stable but would have a higher RCS, and may have a perimeter that prevents insertion from the top of the right cone.

To accommodate precise alignment of mounting fixtures attached to the top plug 1, an alignment recess can be cut into the top of the top plug, as shown in FIGS. 1, 2*c*, 2*d*, 2*e*, 3 and 7. The taper angle on the recess walls is chosen so as not to form a dielectric resonator or produces any 90 degree angles. Alignment can be achieved through the use of a recess, pins, holes, grooves, key ways, and the like.

The shape described provides for rotational stability, a mechanical pinch with the stressed-skin 13 at the base of the top plug 1, enhanced foam compression at the base of the top plug 1, an alignment recess for precise axial alignment of mounting fixtures, insertion and extraction of the top plug 1 from the top of the right cone, and a RCS design free of corner reflection and dielectric resonator effects.

For the ITSS to operate without an excessive consumption of compressed gas 31, the inflatable right cone requires seals that approach leak-tight conditions at both the top plug 1 and chamfer base 14. A net leak rate of 1 standard cubic foot of gas per hour is acceptable. To achieve a tight seal at the top of the right cone, the top plug 1 is encased in a low dielectric constant heat shrinkable-film 2 material. Due to the shape of the top plug a thin sheet of shrinkable-film 2 must be able to shrink approximately 50% to encapsulate the top plug 1 without any folds or wrinkles.

When this encapsulated top plug 1 is inserted in a right cone, compressed gas 31 will force the top plug 1 upward to a fully seated position. The intentional compression of foam at the base of the top plug 1, due to its shape, causes the gap between the stressed-skin 13 material and the shrinkable-film 2 to diminish. As this gap diminishes the stressed-skin 13 and heat shrinkable-film 2 material forms a low conductance (small air gap) surface-contact gap. After the right cone is inflated, the foam continues to compress and flow until an equilibrium condition develops. During this period of plastic flow, the foam top plug 1 conforms to the stressed-skin 13 material and develops a tight seal after approximately one day. Because the seal is at the base of the top plug, the effective radius for calculations of load bearing capacity is determined by the maximum diameter at the base of the top plug 1.

Because the load on the shrinkable-film 2 at the seal is compressive, a broad range of thin low dielectric constant materials with at least about 50% shrinkage are acceptable. For a closed-cell foam top plug 1, the tensile strength of the shrinkable-film 2 is not important. If the top plug 1 uses an open-cell foam or has an intentional hole or an unintentional crack, then the shrinkable-film 2 must have sufficient tensile strength to span any unsupported gaps. A shrinkable-film 2 with a pre-shrink thicknesses of 1 mil is acceptable. Thicker material can be used but would increase mass and RCS of the ITSS without providing any increased capability. Thinner material would be advantageous, but the film must not puncture during normal handling. The shrinkable-film 2 forms a smooth leak tight encapsulation of the machined surfaces of a top plug 1 and forms a low conductance surface-contact seal with the stressed-skin 13.

Various shrinkable films are suited for use in the present invention, these include: ionomer, polybutylene, polyester, polyethylene, EVA copolymers, oriented polyethylene, cross-linked polypropylene, linear low-density polyethylene, and the like.

The overall utility of the invention depends on its rigidity. If used outdoors, it must be able to withstand local wind conditions. For electromagnetic measurements, the ITSS must (1) retain its axial symmetry as quantified by a run out measurement at the top plug 1 and (2) return to the same equilibrium position if it is deflected by a transverse force.

The taper of the top plug 1 and its compressive seal provide a secure mechanical connection between the top plug 1 and stressed-skin 13. The top plug 1 serves as a stiffening ring to provide a fixed boundary condition at the top of the right cone. The width of the seal region, internal forces, and friction between the foam top plug 13, shrinkable-film 2, and stressed-skin 13 prevent movement between the top plug 1 and stressed-skin 13 after reaching an equilibrium condition. This lack of movement means that the boundary condition at the top plug 1 is fixed and the stressed-skin 13 takes on the axial symmetry of the top plug. The ring seal clamping assembly (FIG. 8) at the chamfer base 14 of the ITSS provides another circular fixed boundary condition. An appropriate engineering model to estimate torsional rotation and transverse deflection is a thin-shell truncated cone with fixed boundary conditions at the top and bottom. This model provides good agreement between theory and experiments.

A three point support 27 consisting of turn buckles with differential threads below the chamfer base 14 is used to axially align the support. Run out measurements, defined as the variation in top plug 1 center axis as a function of axial rotation, are limited by the quality of the axial rotation device (not shown), specifically the bearing quality. Typically, these units are rated to 0.3 degrees axial variation, which corresponds to the run out observed during measurements. If mounted on a suitable positioning unit (not shown), the ITSS support can be adjusted to minimize run out to approximately 1 mil. An 8-ft high ITSS mounted on a typical axial rotation device has a run out of approximately about 1 mm.

For outdoor use transverse deflection due to wind is a means of quantifying rigidity. An ITSS 30-ft high, 112-inches at the base, and 48-inches at the top, made of 10-mil Mylar has a predicted load capacity of 900 lb and would deflect 4.14 inches at the top in a 40 knot (46 mph) wind. An ITSS 30-ft high, 112-inches at the base, and 42-inches at the top, made of 5-mil TCK (Teflon Coated Kevlar) has a predicted load capacity of 900 lb and would deflect 1.02 inches at the top in a 40 knot (46 mph) wind. The forces producing these deflections are equivalent to a 175 lb transverse force applied to the top of the ITSS. In normal operation, with a wind below 10 knots the deflection would be reduced by a factor of 16. The 10-mil Mylar support would deflect ¼ inch (or 3 degrees in phase at 400 MHz), and the 5-mil TCK support would deflect 1/16 inch (or 0.75 degrees in phase at 400 MHz). This stability is sufficient for 25 dB to 37 dB vector subtraction measurements of a target mounted on a 10-mil Mylar or a 5-mil TCK ITSS, respectively.

At an indoor facility the usefulness of an 8-ft high ITSS for vector subtraction measurements was quantified. A round plate was mounted on this ITSS and its RCS measured from 2 GHz to 18 GHz. The plate was removed and the ITSS intentionally and vigorously deflected ½ inch several times in two orthogonal directions. After this deflection of the ITSS, the plate was remounted and the RCS measurement repeated. Vector subtraction of 36 dB was observed at a 3.6 GHz and 26 dB at 15.5 GHz. These measurements correspond to a repositioning accuracy of approximately 10 mils (or 0.25 mm).

The representative shapes of the top plugs 1 are shown in FIG. 2. We now discuss the relationship between the selection of materials and mechanical design. The competing factors are low RCS and mechanical strength. Just as in the case of the stressed-skin 13 material, the relative dielectric constant of the foam for the top plug 1 must be low, with typical values between 1.01 and 1.06. The higher values correlate with high-density foams. These high-density foams generally have a high elastic modulus for both tension and compression. Foams useful in the present invention are rigid foams (e.g., polystyrene, polyethylene and polyurethane foam). Polystyrene foam is available from Dow Chemical Company under Styroform®. Polyurethane is available from Dow Chemical Company under Trymer® 190. Dow Chemical Company also manufactures a rigid polyethylene foam under Ethaform® 220 with a density of 2.2 lb/cu. ft.

The mechanical properties of a foamed plastic are related to the properties of the plastic as a non-foamed solid. The mechanical properties of a foamed plastic are approximately equal to the properties of the solid plastic times the square of the ratio of the foam density to the polymer density. Consequently, low-density foams, such as the ubiquitous styrofoam cup, with a density of 1.5 lb/cubic ft typify the limits of practical structural foams. Lower density foams made from a wide variety of polymeric materials exist, but their mechanical properties are low. Foams in the 1.5 to 2.0 lb/cubic ft are machinable with common shop tools. Foams of lower density are more difficult to fabricate but can be cut with sharp tools and hot wires or shaped with abrasive materials.

Foamed plastics have a characteristic that their elastic modulus is a function of both the applied stress and time the stress is applied. A cantilevered foam beam, for example, will deflect due to an applied load. The initial deflection is prompt, but the beam deflection continues to increase slowly, reaching an equilibrium displacement in several days. This continuous deflection is referred to as creep. The top plug 1 is made of foam and the mechanical design incorporates creep into the shape of the top plug 1 to form a seal and a fixed boundary condition at the base of the top plug 1.

Nonuniform loading refers to application of a load to an elastic body in a way that results in a nonuniform stress and nonuniform tension or compression. In application to the ITSS, a nonuniform loading design is applied to the top plug 1 to compress the foam. This nonuniform compression serves three purposes.

First, it assures that the top plug 1 will form a tight seal at the base. Any slight groove or other imperfection on the sides of the top plug 1 near the base of the top plug 1 that could form a channel for a leak is compressed by nonuniform loading with maximum compression at the base. The percentage of compression is chosen so the foam must respond visco-elastically and creep to an equilibrium state forming a smooth surface at the bottom of the top plug 1. This formed-in-place surface is less likely to develop a leak, than a uniformly loaded top plug 1.

Second, nonuniform compression establishes a fixed boundary condition at the base of the top plug 1 which serves to terminate and stiffen the stressed-skin 13 of a right cone. The load capacity of a top plug 1 with a seal at its base is greater than if the seal were at the top of the top plug 13 or if the sealing region was uniformly loaded from bottom to top. The load is higher because the effective diameter and area is larger at the bottom of the top plug 1, than for a design where a seal is imposed at the top of the top plug 1 or if the top plug 1 is uniformly loaded from bottom to top.

Third, because the seal is at the base of the top plug 1, the effective unsupported height between the top plug 1 seal and the base is a minimum. Because the magnitude of a transverse deflection is proportional to the cube of this height, this design assures a deflection close to the minimum possible.

Nonuniform compression is achieved by tapering the foam top plug 1 so as to bind at its base, when forced upward within a stressed-skin 13 of differing taper angle, as shown in FIGS. 1, 3 and 7. The difference in taper angles between the top plug 1 and the stressed-skin 13 determines the quality of seal and loading at the base of the top plug 1. The hoop stress in the stressed-skin 13 material causes the stressed-skin 13 material to stretch and increase in diameter when inflated. The increase depends on diameter, inflation pressure, and elastic properties of the stressed-skin 13 material; and requires a biaxial stress calculation. An increase of about 0.5% on the diameter of the stressed-skin 13 is typical. The stressed-skin 13 is undersized by whatever this percentage is estimated to be. For example, depending on the material and the dimensions of the support, the percentage can range from about 0.1% or less to about 10% or greater.

The top plug 1 taper angle is selected so as to result in about a 50% reduction in hoop stress at the top of the top plug 1 compared to the base. The exact taper angle depends on creep, the base diameter, and the height above the base that the upper edge of the stressed-skin 13 extends. A typical shape would produce a designed compression at the base of the top plug 1 that exceeds the compressional loading at the top of the top plug 1 by a factor of about two. Other ratios will work but depend on the exact geometry of the top plug 1 and the elastic modulus of the foam material used. A taper angle difference of 0.25 degree over a distance of 4 inches on a Styrofoam® top plug 1 reduces loading by about 50% at the base of a 12-inch diameter top plug 1 designed to mate with a stressed-skin 13 that is 8-ft high and has a taper angle of about 6.25 degrees.

For measurements below 1 GHz scattering from the top plug 1 dominates that of the stressed-skin 13 and any method to reduce the mass of materials in the top plug 1 and consequently the effective dielectric constant of the top plug 1 will reduce RCS. Reduction in foam mass is in general desirable, because it reduces the electrical interaction between a target and the top of the ITSS. The homogeneous axial-symmetric design is ideal for reduction in RCS and minimization in RCS variations from the support as a function of its azimuthal angle. For some applications only one clutter measurement is necessary to characterize the support.

The compressive modulus of foamed plastics in the 1 to 3 lb per cubic foot density is significantly greater than that required to support a target and withstand the internal pressure within the ITSS. A significant reduction in RCS is achieved by hollowing the top plug 1 (see FIGS. 2*b*, 2*d*, and 2*e*). A top plug 1 with about a 50% reduction in mass would have sufficient strength to withstand the internal pressure of the ITSS, but its RCS would be about 6 dB less below 1 GHz. Removing more material to reduce RCS is possible but the mechanical properties of the top plug 1 may degrade to an unacceptable level. Removal of material must be done in a way so that (1) there are no parallel surfaces that could form a dielectric resonator and (2) the top plug 1 has no surfaces that form a 90 degree angle.

Figure 6:
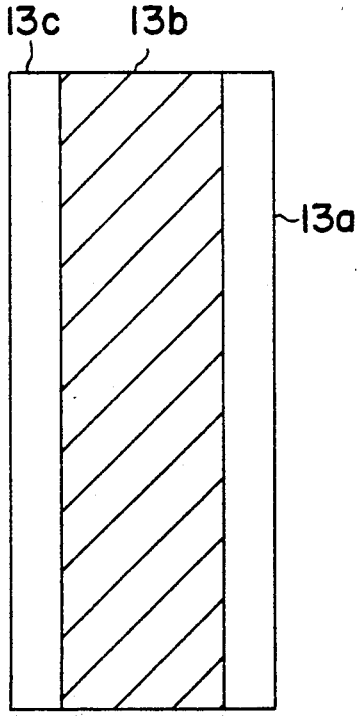
FIG. 6 is a sectional view of a laminated sheet material used in constructing the hollow plugs shown in FIG. 2.

An alternative method to construct a low RCS top plug 1 is to construct it out of plastic-foam laminates see FIG. 6. The plastic 13 would have a high elastic modulus and a high tensile strength. Foam 13*a* is used to stabilize the laminated structure. An analysis has shown that such laminates can be designed to have superior mechanical characteristics compared to foam and a lower RCS than foam for the same structural task. A greater percentage of hollowing can be achieved with laminate materials than by mechanically removing material. Below 1 GHz, the RCS of a top plug 1 constructed of such laminates is much lower than a solid foam top plug about 1 or about a 50% hollowed plug. These laminate materials can be formed into a plastic-foam-plastic planar sheet (FIG. 6), so as to provide a stiff low RCS sheet material to construct the interior of a top plug 1 or as a building material for low RCS target support structures. The laminates can also be formed in a symmetric pattern with the high elastic modulus plastic formed into circular, hexagonal, or crossed cells with foam filling out the pattern and providing stabilization. In this configuration, the laminate would have a high compression modulus and so provide a low RCS load bearing material. This material could be used to form the exterior surfaces of a top plug, would be thin, and have a low RCS.

The shape of the top plug 1 is the result of trial and error. Initially, the top plug 1 surfaces were parallel and the side taper and stressed-skin 13 taper were identical. Nonuniform loading at the bottom of the top plug 1 evolved, because uniform loading of the seal resulted in a leak.

Significantly different designs have been considered. To minimize mass, the top plug 1 could be constructed of an inflatable top plug 3 with an external inflatable ring. The detractors for these designs is the feed lines to pressurize the top plug 1 and ring and the lack of rigidity. Foam serves as a stiffening ring with a compression modulus on the order of about 200 psi. An inflated top plug 1 with this compression modulus would be hard to build. The consideration of a totally inflated top plug 1 was abandoned because this design would not serve as a stiffening ring and so detract from the mechanical stiffness of the ITSS.

A hollow laminated top plug 1 could be fabricated and pressurized with an inflatable insert in the hollow regions of FIGS. 2*d* and 2*e*. Portions of that top plug 1 that are rigid but are also subjected to a high compressive load could be preloaded with an ultra-low density material such as aerogel and the like. The advantage would be a reduction in mass and corresponding reduction in RCS.

The stressed-skin 13 of a ITSS is stressed by inflating it. This internal pressure pushes the top plug 1 to the top of the cone and provides the force necessary to support a load. The maximum load is approximately equal to the top plug 1 base area times the internal pressure. The stressed-skin 13 must withstand this internal pressure which produces a circumferential hoop stress and an orthogonal vertical stress. A stressed-skin 13 material must have a high tensile strength and a low dielectric constant to have a low RCS.

An axially symmetric thin-shell structure that is inflated has a circumferential hoop stress in the stressed-skin 13 material that is equal to the internal pressure (psi) times the radius (inches) divided by the material wall thickness (inches). There is also a vertical stress, orthogonal to the hoop stress, which is half the magnitude of the hoop stress. Because the load capacity of the right cone is proportional to pressure, an increase in pressure increases the load capacity of the ITSS but increases the hoop stress. If the hoop stress exceeds the yield point of the stress-skin 13 material, the material will fail. Consequently, the design is to minimize the chamfer base 14 diameter. Good mechanical design require the maximum hoop stress be about ⅔ the yield stress to prevent ripping of the material when punctured. A good mechanical design is a right cylinder; but it produces the highest RCS.

The shape of the stressed-skin 13 in addition to its dielectric constant and thickness are the primary factors that govern scattering from the stressed-skin 13. Low RCS supports can be fabricated with axial symmetry or non-axial. The axial-symmetric design permits simple rotation of target and support. A non-symmetric design can provide a lower RCS but is more complicated to construct and use.

The design considered is the frustum of a right cone, as shown in FIGS. 3 and 7. To minimize RCS the right cone is tapered so the base is larger in diameter than the top plug 1. Physically, this taper angle redirects a specular return from the stressed-skin 13. Computations of RCS indicate a taper angle of 5 degrees or more produces a low RCS below 1 GHz. This taper angle produces a good seal at the top plug 1, and the conical shape is a minor departure from a right-circular cylindrical shell, which has high mechanical rigidity. A truncated cone is sufficiently rigid for the purposes described. In practice, a taper angle of approximately 6 degrees is used. For a tuned system, which is optimized for performance over a specific band of frequencies, a greater or lesser taper angle can also be utilized.

For the purpose of minimum RCS over a specific range of bistatic or backscatter angles, the ITSS with an ogive shape 14*c*, 14*e* or an elliptical shape 14*a* or diamond shape 14*d*, instead of a truncated cone, would provide a lower RCS. The major disadvantages would be a reduction in mechanical stability and a tendency of the stressed-skin 13 to take on a circular symmetry 14*b*. Both disadvantages require some form of internal structure to correct. The added complexity of the design plus more construction material detract from the overall reduction in RCS.

The RCS for a truncated cone has a complex theoretical formulation. An approximate result of that analysis is that RCS is approximately proportional to the dielectric constant minus one quantity squared, times the material thickness squared. To achieve a low RCS the stressed-skin 13 material must be thin and have a low dielectric constant. The stressed-skin 13 thickness for the ITSS is proportional to the internal pressure and inversely proportional to the skin-material tensile strength. Materials can be selected by establishing a stress-strain chart of a candidate material and using the tensile strength of one half the yield point. The quotient of the square of the dielectric constant minus one divided by the square of the yield stress, is referred to as a material figure of merit (FOM), and provides a means to rank the suitability of stressed-skin 13 materials and select a minimum RCS.

New plastic film materials, such as Poly P-Phenylene Benzobisthiazole (PBZT), are being developed. These new materials are expensive, are not commercially available, nor has an adhesive or sealing technology been developed for these polymers. Other woven polymers, such as Mylar coated Kevlar for wind-surf sails, and Teflon coated Kevlar, for radomes are commercially available. The primary difficulty with rip-stop material is its thickness, typically 5 mils or greater. In many instances, a 2-mil plastic film such as Mylar produces a lower RCS, for light-weight targets.

Practical factors that affect the selection of stressed-skin 13 material are width of stressed-skin 13 material, adhesives or an appropriate means for sealing, and environmental concerns. Outdoors the local wind and environment must be addressed: materials with embedded fibers provide rip-stop protection and increased tensile strength, ultraviolet inhibitors in the stressed-skin 13 material mitigate the effect of the sun, and removing surface moisture and cleaning the stressed-skin 13 with common solvents is an operational concern. Indoor use of the ITSS can be optimized for low RCS by use of thin films without rip-stop protection.

The lowest RCS stressed-skin 13 would involve a seamless construction and a gradual reduction in stressed-skin 13 thickness from the base to the top plug. This variation in stressed-skin 13 thickness would provide a thicker stressed-skin 13 where the hoop stress is highest (at the base) and minimize stressed-skin 13 thickness (by a factor between 2 and 4) near the top plug, where stressed-skin 13 diameter and hoop stress is lower. This reduction in stressed-skin 13 thickness near the top plug 1 would reduce the target-skin interaction and reduce RCS. A reduction in stressed-skin 13 thickness by a factor of 2 would reduce the scattering per unit length from the stressed-skin 13 by a factor of 4 (or 6 dB). The reduction in stressed-skin 13 thickness would also reduce coupling between a target and the ITSS by reducing the mass of material in the immediate region near the target.

A low-RCS stressed-skin 13 would involve seamless construction to eliminate seam scattering as well as a skin-thickness gradation. For thermoplastics such as Mylar and Kapton, a bubble extrusion process and thermal forming would be appropriate. Fibers such as Kevlar impregnated with resin could be wound on a mandrel, cured, and ground to form a seamless stressed-skin 13 with the required thickness gradation. Such processes are expensive but provide the lowest RCS. For frequencies below 1 GHz, the RCS of the plug dominates and the major advantage of tapered thickness construction is additional mechanical strength that permits ITSS to achieve to heights in excess of 40 ft. Above 1 GHz, seamless construction eliminates the RCS associated with scattering from the seam 20 joint.

For the ITSS constructed with seams 20, the RCS of the seam 20 is an important consideration. Analysis and measurements confirm that a spiraled seam 20 produces a lower RCS than a straight line vertical seam. The angle of the spiral is chosen to match the taper angle of the truncated conical stressed-skin 13. This causes the specular reflections from the seams 20 to occur at the same angle as the specular return from the stressed-skin 13. Because the return from the stressed-skin 13 is large at the specular angle the specular seam return is inconsequential. The analysis also indicates the cross coupling of horizontal-polarized radiation to vertical-polarized radiation and vice versa by the seams 20 is a function of the seam 20 angle. This cross coupling is reduced by spiraling at the taper angle of the truncated cone.

Figure 5:
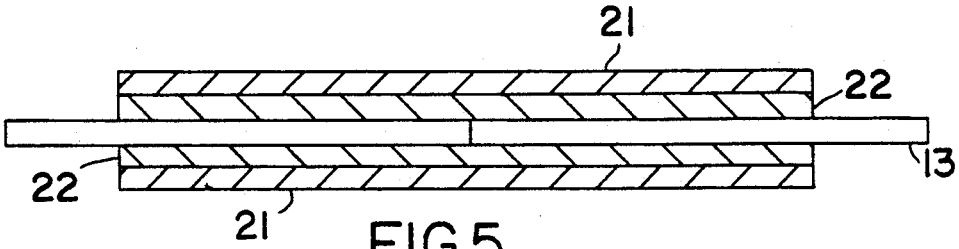
FIG. 5 is a sectional view of a quadruple lap joint used for joining the inflatable stressed-skin.

For stress-skins 13 made of Mylar skins, commercially available adhesives and adhesive tapes can be used. The seam joint (FIG. 5) used for a Mylar stressed-skin 13 is a quadruple lap joint 21, 22, as shown in FIG. 5. A quadruple lap joint 21, 22 is formed by butting the stressed-skin 13 material together then applying a tape 21 above and below the joint. This joint forms four lap joints but are arranged symmetrically so that rotational forces in the joint, which result in a peel force, are minimized.

Conventional surface preparation techniques can be used to obtain a good bond. Plasma activation of the surface can be applied to increase bond strength and lifetime. Accelerated seal lifetime measurements indicate a Mylar ®-Mylar ® seal lifetime in excess of 2.5 years.

For the ITSS stressed-skin 13 made of Mylar or other plastics, a number of commercially available tapes can be used to strap a target to the top plug. The problem is that tape affixed to a foam right plug will stick but will tear the foam apart because the foam has low tensile properties. Tape affixed to a Mylar stressed-skin 13 has the advantage of a high tensile strength substrate that does not tear apart. For the same hold-down task, less tape is required for a Mylar ITSS than an identical foam right cone. This reduction in tape is a reduction in RCS and provides for a lower target-support interaction. Both factors are favorable to precision measurements.

Adhesives useful in practicing the invention include Sheldahl's T-300 (dry film adhesive on Mylar ® substrate), Whittaker Corp.'s two-part laminating resin, GE's RTV 108, Kapton tape (an acrylic adhesive on a Kapton ® substrate) and 3M's 9460 (an acrylic transfer adhesive). Kapton ® tape and 3M 9460 are recommended for short term usage.

The ITSS is typically mounted on a azimuthal and/or elevation positioning device. The base is the part of the ITSS that accommodates this interface. It must terminate the stressed-skin 13 material, provide a leak tight seal, transfer the vertical stress from the stressed-skin 13 to the chamfer base 14, and mount to a positioner 28, via a support ring 33, and an adapter plate 34 which allows mounting to a wide varity of positions.

Figure 8I:
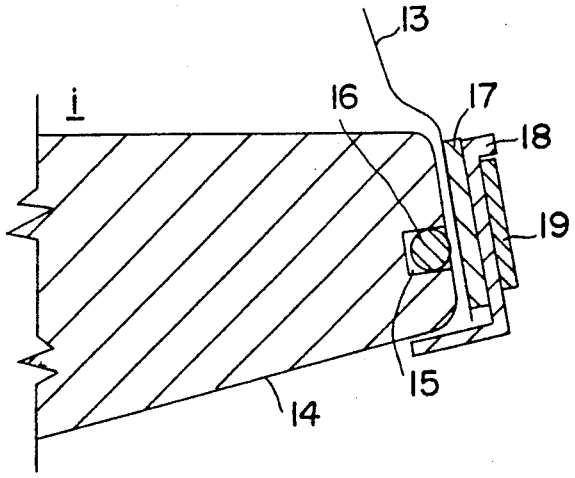
FIGS. 8A–8C are sectional views of the base with various sealing means.
Figure 8J:
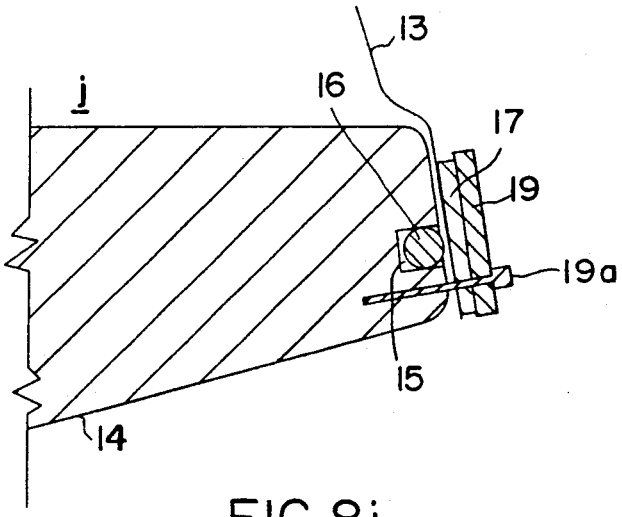
Figure 8K:
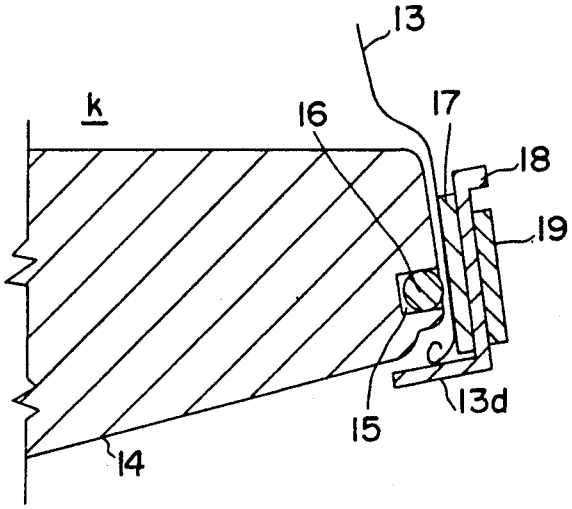

The chamfer base 14 of the invention is circular and the outer edge is detailed in FIGS. 3 and 8. The edge of the chamfer base 14 is tapered to match the taper angle of the truncated cone, has a clamping region, has an O-ring 16 and O-ring groove 15 to form a chamfer base 14 to stressed-skin 13 seal, has appropriate chamfers **14*d* to stretch the stressed-skin 13 and accept a roped edge 13*d*, and mates with a Z-shaped ring seal 18. The ring seal is a metal strip 19 in one or more pieces that fits around the chamfer base 14 perimeter and is held in place by radial screws 19*a* to the base as in FIG. 8*i* or is mechanically locked to the chamfer base 14 as in FIGS. 8*i* and 8*k*. The inside surface of the ring carries an adhesive 17, such as a silicone elastomer on an acrylic transfer adhesive, that grips the stressed-skin 13 material. The vertical stress of the stressed-skin 13 is transferred to the chamfer base 14 via this adhesive to ring-seal joint 18, 19**.

The vertical load is transferred from the ring seal to the chamfer base 14 in FIG. 8 by the radial screws **19*a* and friction due to the radial loading of the joint by the screws 19*a*. A mechanical locking system is sketched in FIGS. 3 and 8 that transfers the load by a Z-shaped ring 18 to the underside of the chamfer base 14, by a large lip. This lip forms a 90 degree angle and the chamfer base 14 is beveled to accept this shape. The screws 19*a* in FIG. 8*i* or the band 19 in FIGS. 3 and 8*i* or 8*k* provide the radial loading to compress the O-ring 16 and load the joint to prevent stressed-skin 13 material slippage. The slight lip on the Z-shaped ring 18, shown in FIGS. 3 and 8, prevents the band 19 from slipping upward. The exact loading of the joint necessary to prevent slippage is a function of the stressed-skin 13 material, surface preparation, and choice of adhesive. If the stressed-skin 13 material is fabricated with a roped edge 13*d* at the chamfer base 14 as shown in FIG. 8, then the Z-shaped ring 18 can compress the O-ring 16, clamp the stressed-skin 13 material, and capture the roped edge 13*d* at the chamfer base 14** without using any adhesive.

Prestressing refers to application of tension or compression to an elastic material so a system is stressed without the imposition of an external load. In the present invention, a prestressed design is applied to the chamfer base 14 to stretch the stressed-skin 13 prior to inflation **13*e*. The chamfer base 14 seal shown in FIGS. 3 and 8 has a design that permits prestressing the stressed-skin 13 prior to clamping and inflation. FIGS. 3 and 8 shows a chamfered edge 14*d* that permits prestressing a conical stressed-skin 13 without danger of tearing the material on a sharp edge. Prestressing is achieved by installing the stressed-skin 13 material on the chamfer base 14 and pulling the material down. During fabrication of the conical stressed-skin 13, alignment marks are made on the stressed-skin 13 that line up with a feature on the chamfer base 14, such as the O-ring 16. These marks simplify accurate axial alignment of the stressed-skin 13 and precise prestressing of the stressed-skin 13 in the region of the O-ring 16 seal and clamping region. The material is stressed so as to stretch approximately the same percentage on the diameter 13*e*; as the percentage increase in the stressed-skin 13** diameter due to the hoop stress produced by inflation of the ITSS in operating pressure.

Prestressing has two advantages over a chamfer base 14 design that does not use prestressing. First, the material in the clamping and O-ring 16 regions (below the chamfer **14*d* and over the O-ring groove 15) is in equilibrium, so that inflating the ITSS will not produce an increase in stressed-skin 13 diameter. Consequently, the material in this region can be clamped prior to inflation without any wrinkles, and after inflation shear forces that may tend to tear the stressed-skin 13 material at the chamfer base 14** are minimized.

Second, upon inflation the material that conforms to the chamfer as shown in FIGS. 3, 7, and 8 will increase in diameter by the prestressed percentage and form a conical shape that terminates at the chamfer base 14 seal. This design specifically accounts for the stress due to inflation: the material next to the O-ring 16, in the clamping region, and in the chamfered region all have uniform hoop stress after inflation. Without prestressing, the material above the clamped region would balloon outward and so deviate from a conical structure. This ballooning near the chamfer base 14 seal will spoil the fixed boundary condition and decrease the rigidity of the support.

The boundary conditions of the stressed-skin 13 material at the chamfer base 14 influences the stability of the right cone. The material above the O-ring 16 seal is aggressively clamped to the chamfer base 14. This provides a fixed boundary condition. In practice it is important to stretch the stressed-skin 13 material at the chamfer base 14 by the same amount the hoop stress will elongate it when the ITSS is inflated. This pre-stressing has several functions. It eliminates any folds in the stressed-skin 13 material that can produce a leak and provides a smooth surface of uniformly stressed material prior to adhesive clamping. To accommodate this pre-stressing of the stressed-skin 13 the edge 14*d* at the top of the chamfer base 14 must be chamfered to assure the material will slip 13*e* over the top without tearing or other mishap. The bottom edge is also chamfered to accommodate a stressed-skin 13 with a roped-edge 13*d* termination.

A Z-shaped ring 18 seal is not the only shape that could form a suitable seal and load transfer mechanism. A Z-shaped seal is a shape that serves the required purposes with 90 degree angles. This choice of angle is easy to find in standard extruded shapes. A custom extrusion with other angles could be specified but would only be a minor variation on the Z-shaped with no additional advantages.

The chamfer base 14 has the necessary rotary pneumatic fittings 32 to permit axial rotation, and a three-point screw 27 support system to simplify axial alignment. A pneumatic control 29 is used to regulate the inflated stressed-skin 13 cone. FIG. 7 shows a control unit (not in detail) with a high pressure input, a supply line 30 to the chamfer base 14 and a sense line returning from the chamfer base 14 (not shown). In one aspect, the pneumatic control 29 consist of a low pressure line regulator (such as a MG series 170 #6500-0105 from Phoenix Distributors) to regulate shop air (60–100 psi) to the desired inflation pressure, typically about 0.5–3 psi. The pressure can be sensed using a pressure gauge. In another aspect, the pneumatic control 29 includes diagnostic equipment (such as flow meters); redundancy (such as an electrical regulation system using pressure switches and solenoids to bypass the mechanical regulator in case of failure); fast fill option (a direct mechanical connection bypassing the regulator to rapidly inflate the stress-skin 13 cone to operating pressure). A bottle supply can also be used. Piloted values are used at the chamfer base 14 to seal the system when pressure in the system drops below a certain level.

The instant ITSS is hollow on the inside, broad-band absorber 25 can be placed within it to cover the chamfer base 14. This absorber 25 reduces the electrical interaction between a target and chamfer base 14. An experiment has demonstrated a 35 dB reduction in this interaction. The inclusion of broad-band absorber 25 is an asset to a precision RCS measurement.

To complement the absorber 25 in the chamfer base 14 of the ITSS, a radio-frequency (RF) gasket 26 can be designed to fit over the truncated cone at the chamfer base 14, snugly. The designs provide for a snug fit by over-sizing the outside diameter of the absorber 25 within the chamfer base 14 and under sizing the inside diameter of the RF gasket 26. The purpose of the RF Gasket 26 is to terminate electromagnetic waves, which can originate (1) as a reflection from a target towards the chamfer base 14 or (2) as a wave originating at the target propagating to the chamfer base 14 guided by the stressed-skin 13 material. This gasket 26 is large enough in diameter to prevent direct illumination of extraneous machinery at the chamfer base 14 that may produce other undesirable reflections.

The RF gasket 26 is made of laminate absorber. This material has a low conductivity side and a high conductivity side. In use, the low conductivity side is positioned to face the source of RF emissions. The low conductivity side provides a good match to free space and a small reflection. The RF gasket 26 design used on the ITSS incorporates the use of two sheets of laminate absorber. The high conductivity surfaces are bound together so as to produce a conductivity profile that is low-high-low. Scattering from this low-high-low assembly is lower than using a single sheet of laminate.

Absorber 25 is available commercially from Rantec Anechoic, Advance Electromagnetic, Inc., Advanced Absorber Products, Inc., and Emerson and Cuming, Inc. The RF gasket is also constructed from carbon-based absorber which is available from Rantec (FL-4500, FL-2250).

The low return from a low-high-low conductivity profile has been modeled by Epstein and Budden (see Epstein, P. S., "Reflection of Waves in an inhomogeneous absorbing medium," Proc. Nat. Acad. Sci., Wash, Vol 16, pp. 627–632, 1930. and Budden, K. G., The Propogation of Radio Waves, Cambridge, UK: Cambridge Univ. Press, 1985, pp. 470–475, 550–582.) in the context of reflections from the earth's ionosphere. Assembly of two sheets of laminate was modeled with a six-layer planon reflection model and indicated a lower return than for one sheet or a low-high-low-high arrangement.

The primary purpose of the ITSS of the invention is to support targets and antennas in a non perturbing manner so as to permit precision electromagnetic measurements of antenna patterns and electromagnetic scattering. The reduction in target-support interaction at the top plug, the low RCS of the support, and reduction in target-ground (chamfer base 14 or positioner 28) each contribute to a precision measurement.

The hollow interior of the ITSS can also be utilized as a chamber to place a target, e.g., amorphous targets, typified by gases, vapors, aerosols, smoke, dust, suspensions, or other substances which are difficult to measure.

An ITSS fabricated with an aluminum base and Mylar skin would be an ideal confinement vessel for a plasma absorber. The plasma absorber is produced by ultraviolet photoionization of trace amounts of tetrakis (dimethylamino) ethylene, TMAE, or ionizable molecule in a noble gas background which is slightly above atmospheric pressure. With no load requirement for the ITSS, the stressed-skin 13 material can be very thin, so the confinement vessel has low RCS. Both Mylar and aluminum are chemically compatible with TMAE and the leak tight construction of the ITSS is sufficient to prevent atmospheric constituents from entering the system.

The instant ITSS could be used as a structural member for tensional or compressional loads. The lightweight nature of the ITSS make it a candidate for use in space where mass is expensive. As a structural member, RCS considerations can be relaxed and thicker stressed-skins 13 and solid high density foams can be used for the top and bottom plugs.

A low RCS piston can be made using the present teachings. A piston could be made from a seamless Mylar tube with the ends tapered to form the seal described herein.

The present invention offers the possibility of correcting for structural compression due to application of a heavy target. For a tall support and a heavy load, a compression on the order of an inch is expected. To correct for this compression, the ITSS is calibrated so the height as a function of load and applied pressure is known. Prior to application of the load the ITSS is sealed off from the pneumatic control, and a differential pressure gauge is, zeroed. The load is applied, and the pressure increase measured by the differential gauge is proportional to the target weight. The compression of the ITSS can be estimated from a prior calibration, and the ITSS can be inflated to a slightly higher pressure so as to return the target to a pre-established reference position.

The ITSS with an opaque target is an unusual combination. If the ITSS is made with a clear material, such as clear Mylar, it provides an illusion of an object floating in space. This draws the attention of people and could be used for the purposes of advertising. Support of an automobile with four ITSS is technically possible. Support of people to a height of 5 ft has already been demonstrated.

The present invention can also be applied for the purpose of forming a pressurized container. The top and bottom seals could be made with foam plugs and a shrinkable-film 2. The shrinkable-film 2 could also serve the purpose of bonding the foam plug to the foam and the exterior stressed-skin 13. This bonding would be simplified by selecting all materials for a temperature induced bonding process. The external stressed-skin 13 could be the plastic- foam-plastic laminate described herein. A container made in the fashion of the ITSS would not require any metal. It could have an economic advantage in production. This container would be suitable for gases at pressures of several hundred psi.

One use of this container would be a self-chilling soda-drink container. Chilling would be provided by the expansion of gas contained in a portion of the container. Opening the container would permit the controlled release of pressurized gas from a high-pressure reservoir through a heat exchanger in thermal contact with the soda-drink fluid. The amount of gas in the pressure reservoir limits the amount of cooling. The external stressed-skin 13 provides a thermal barrier to keep the drink cold.

While a particular embodiment of the invention is illustrated and described, the invention is not limited to any specific configuration, since modifications may be made utilizing the principles taught without departing from the inventive concepts. It is contemplated that the appended claims will cover any such modifications as may fall within the true spirit and scope of the invention.

APPENDIX

INFLATABLE TARGET SUPPORT FOR RCS MEASUREMENTS

By

D. Watters and R. Vidmar

AMTA Proceedings, 11th Annual Meeting and Symposium

Monterey, California, pp. 12-15 to 12-19

9-13 October 1989.

INFLATABLE TARGET SUPPORT FOR RCS MEASUREMENTS

D. Watters and R. Vidmar

SRI International
333 Ravenswood Avenue
Menlo Park, California 94025

ABSTRACT

A stressed-skin inflatable target support provides an improvement over a foam column for radar cross section (RCS) measurements in an anechoic chamber. Theoretical analysis indicates that backscatter from the support is minimized because its mass is reduced below that of a foam column and is distributed to favor incoherent scattering. Compared with a foam column, a pressurized thin shell has superior mechanical stability under both axial and transverse loads. Experimental observations using Mylar--a low dielectric constant, high tensile strength film--confirm these results. Spurious reflections from rotational machinery located below an inflatable support.

Keywords: RCS Measurement, Target Support, Stressed Skin, Inflatable Column, Clutter Reduction

1. INTRODUCTION

Anechoic chamber clutter limits both precision and noise floor, making it difficult for RCS engineers to make accurate, low-level RCS measurements. A principal source of clutter is the target support column. A target support column must meet both electromagnetic and mechanical requirements. It must have low RCS over a broad bandwidth and stably support a prescribed weight. For accurate measurement of vector quantities, it is important that the target support be able to return to a reference position after movement.

Traditional target support methods include foam columns, overhead strings, and metal pylons [1]. A foam column has difficulty supporting a heavy load while maintaining a low backscatter, and viscoelastic properties affect its positional accuracy. A string support system is difficult to control and requires an attachment point to the target. Metal ogival pedestals can support heavy loads, but have a larger RCS than other support methods.

An inflatable column offers both low RCS and heavy lift capacity. An inflatable column was designed at RATSCAT in 1964 [2] using nylon-coated neoprene. The column, designed to support 200 lb in a 40-knot wind, was inflated to 0.2 psi and was stable enough to permit vector measurements. Performance of the RATSCAT column was comparable to that of foam. Current advances in material science have given us the ability to fabricate inflatable structures with properties that are superior to foam construction.

An inflatable column has several advantages over a foam column of identical shape. First, an inflatable column has a lower RCS than a foam column. Second, an inflatable column made of a membrane material that is significantly less viscoelastic than foam can have superior mechanical properties, which results in the ability to conduct angular measurements in a more stable manner and to support heavier loads. Finally, ground-related clutter can be reduced over a broad bandwidth by filling the base of the column with broadband absorber.

Section 2 addresses design parameters for an inflatable column, including both electrical and mechanical considerations. Section 3 describes fabrication details that resulted in a prototype structure. Section 4 discusses anechoic chamber measurements, comparing the scattering from a square plate mounted at 45° on a foam column with scattering from the same plate mounted atop the inflatable column.

2. DESIGN CONSIDERATIONS

The two principal requirements for a support column are minimum RCS over a specified frequency range and stable mechanical support up to a specified weight. Design parameters for foam and inflatable columns include: electromagnetic scattering, axial loading, transverse loading, and torsional rigidity. An inflatable column can be designed with minimum RCS and the same or superior mechanical performance compared with a foam column.

2.1. Electromagnetic Properties

The electromagnetic scattering from a column can be estimated by considering the two-dimensional scattering from a class of infinite cylinders [3]. A model for scattering from a foam column is a solid dielectric cylinder whose permittivity is nearly unity. The scattering cross section per unit length is:

$$\frac{\sigma_{\parallel}}{\pi a} = \frac{\sigma_{\perp}}{\pi a} = \frac{\pi}{4} k_0 a (\epsilon_r - 1)^2 J_1^2(2k_0 a)$$

where a is the radius of the cylinder, $k_0$ is the free space wave number, and $\epsilon_r$ is the relative permittivity of the cylinder. The response is the same for either parallel or perpendicular polarization.

For an inflatable column, similar expressions can be derived, where the model is now a cylindrical shell. The scattering cross section per unit length is:

$$\frac{\sigma_{\parallel}}{\pi a} = \pi (k_0 a)^3 (\epsilon_r - 1)^2 \left(\frac{d}{a}\right)^2 \cdot \left| \sum_{n=0}^{\infty} \epsilon_n (-1)^n J_n^2(k_0 a) \right|^2$$

$$\frac{\sigma_{\perp}}{\pi a} = \pi (k_0 a)^3 (\epsilon_r - 1)^2 \left(\frac{d}{a}\right)^2 \cdot \left| \sum_{n=0}^{\infty} \epsilon_n (-1)^n \left[ J_n'^2(k_0 a) + \frac{n^2}{k_0^2 \epsilon_r a^2} J_n^2(k_0 a) \right] \right|^2$$

where $\epsilon_n = 1$ when $n = 0$ and $\epsilon_n = 2$ when $n > 0$, and d is the shell thickness. Slightly different values are obtained for parallel and perpendicular polarization.

Figure 1 is a plot of scattering per unit length as a function of frequency for a 12-in. diameter foam cylinder of permittivity 1.04 (dashed curve) and a 12-in. diameter Mylar shell of thickness 0.002 in. and permittivity 2.8 (solid curve). At low frequencies, scattering from the inflatable structure is considerably reduced compared with that from a foam column. At sufficiently high frequencies, this inflatable column would exhibit a high RCS because the film thickness approaches a significant fraction of a wavelength.

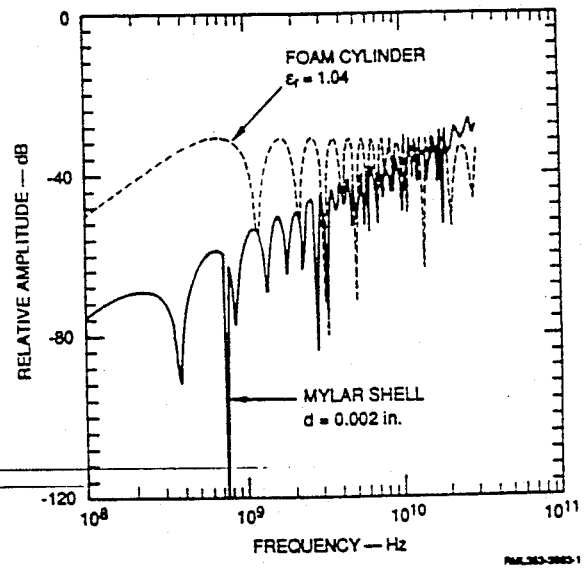

Fig. 1. Normalized Backscatter Cross Section per Unit Length from Infinitely Long Cylinders Cone-shaping of either column can be used to further reduce the direct backscatter.

2.2 Mechanical Properties

The model for comparison of mechanical properties is a column that is fixed at one end and free to move at the other. The maximum buckling load, W, for a foam column is given by [4]:

$$W = \frac{\pi^3 a^4 E}{16 L^2}$$

where a is the radius of the column, L is the height, and E is the elastic modulus. The maximum load for an inflatable column is determined by the cross-sectional area at the top and the pressure in the column.

The pressure, P, in the column is limited by the maximum hoop stress, $S = Pa/d$, (which occurs at maximum radius). The maximum load is: $W = \pi adS$, where d is the film thickness. For taller columns, it is appropriate to consider failure due to buckling:

$$W = \frac{\pi^3 a^3 dE}{4L^2}$$

A 10-ft foam column of 6-in. radius and elastic modulus of 1000 psi is capable of supporting 43 lbs, with a safety factor of 4. A 10-ft air column of 6-in. radius would need to be inflated to 0.75 psi to support a similar load. For a cylindrical column, this pressure would exert a 4.5 lb/in. hoop stress (Sd) at the base. A safety factor of two would require the cylinder to withstand 9 lb/in. For a conical column with a base radius of 16 in., the stress at the base would require a design of 12 lb/in. This can be accomplished using 2-mil Mylar. (For comparison, about 20 mils of polyethylene film would be needed to meet the same stress requirement.)

The deflection of a column under transverse loading can be determined to first order using small deflection theory. For a conical foam column, the maximum deflection is:

$$y_{max} = \frac{4FL^3}{3EI_c\left(1 + \frac{\Delta r}{r_1}\right)}$$

where $\Delta r = r_2 - r_1$, $r_1$ is the radius at the top, $r_2$ is the radius at the base, $I_c = \pi r_1^4/4$ for a solid circle, and F is the transverse force.

For an inflatable column, the deflection is:

$$y_{max} = \frac{FL^3}{EI_a}\left[\left(\frac{r_1}{\Delta r}\right)^3 \ln\left(1 + \frac{\Delta r}{r_1}\right) - \left(\frac{r_1}{\Delta r}\right)^2 \left(\frac{1 + \frac{3\Delta r}{2r_1}}{\left(1 + \frac{\Delta r}{r_1}\right)^2}\right)\right]$$

where $I_a = \pi r^3 d$ for a thin annulus.

A comparison of a foam and inflatable construction using the above dimensions indicates that a 10-lb transverse load applied to a 97-in. column will produce a 0.112-in. deflection of a foam column and a 0.332-in. deflection of an inflatable column. (The elastic modulus of Mylar is 500,000 psi)

Although the foam and inflatable columns exhibit similar characteristics, foam is much more viscoelastic than Mylar. Consequently, a full comparison between foam and inflatable construction must treat how the elastic modulus varies as a function of time, temperature, and stress. For example, the elastic modulus may decrease by a factor of 10 in 1 hour while a high stress is applied. This variation in E with time results in a time-dependent deflection. Foam may exhibit an additional deflection of 10%, while Mylar creep is an order of magnitude less. Under severe loading, a foam column may never return to its reference position after the transverse load is removed.

The response of a cylindrical column under torsion can be analyzed using the following equation [5]:

$$\theta = \frac{TL(1 + \nu)}{EI}$$

where θ is the angular displacement, T is the applied torque, I is the moment of inertia for a body of revolution ($I_c$ and $I_a$), and ν is Poisson's ratio. A comparison of the two columns indicates that the foam column exhibits an angular displacement of 0.0016°/ft-lb; while the inflatable column changes 0.0024°/ft-lb.

Although the deflections and angular displacements of this version of the inflatable column are slightly higher than those of a foam column, the inflatable returns to its reference position, reliably. The reliability of return opens up the possibility of high accuracy measurements involving vector subtraction.

3. CONSTRUCTION

The cone-shaped column in Figure 2 was constructed using 2-mil Mylar film. The column is inflated to 0.75 psi, using nitrogen gas, and can support a load of 50 lb. The vertical bag seams are double lap joints using an adhesive tape on both the inside and outside. Stress testing indicates that the material will fail before the adhesive joint. A heat-shrinkable film is applied to a foam plug and inserted at the top of the column. The internal pressure of the bag forces the tapered foam plug to seal the top of the bag. The base is constructed using an aluminum-foam sandwich, with the foam cantilevered beyond the aluminum plates. This arrangement permits absorber, placed inside the column, to cover the aluminum plate. A ring of flat laminate absorber is placed around the outside of the column to complete the RF seal to the base. The Mylar bag is attached to the base using a special adhesive technique.

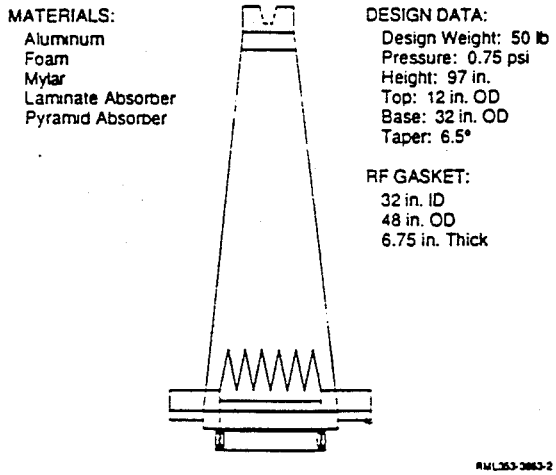

Fig. 2. Stressed-Skin Inflatable Structure

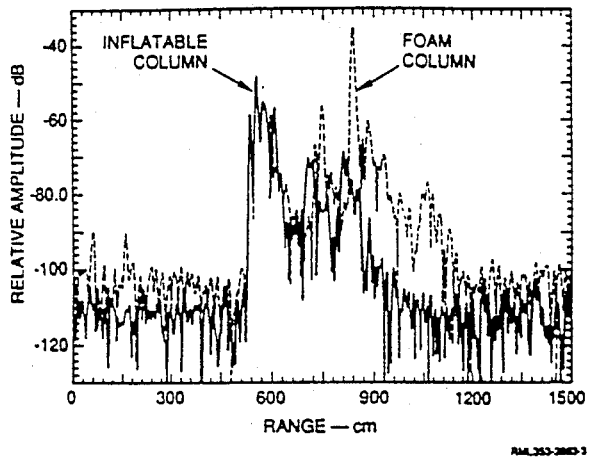

Fig. 3. Scattering From a 45° Plate

Two prototype columns have been constructed and inflated to the design pressure of 0.75 psi. They have operated reliably for three months and are continuing to operate at the time of this submission. Design lifetime is one year or more.

4. PERFORMANCE

Preliminary measurements on the cone-shaped inflatable column have been made in our anechoic chamber [6] using an HP-8510 automatic network analyzer. A comparison is made between the foam column and the inflatable column.

A 45° plate, 14 in. on a side is mounted on the column, in a way to cast a direct reflection toward the base. Figure 3 is a range domain plot of the foam column and inflatable column responses. The horizontal axis represents range in centimeters, the vertical axis is relative amplitude in dB, and the frequency of operation is 600-4600 MHz. The measurement was made using the bare column as a reference and then subtracting this reference from the measurement obtained with the plate on top of the column.

Both curves display three main scattering peaks. Proceeding downrange from the illuminating horns, the first peak represents the scattering from the plate. The fine structure is scattering from the tip, corners, and tail. Small differences between the two curves is attributed to placement of the 45° plate.

The second peak is a triangular path representing scattering from the plate to the base of the column and back to the horn (or vice versa.) The response occurs earlier in time for the inflatable column because its base is higher than the base of the foam column. The amplitude of the response for the inflatable column is reduced by 20 dB over the foam column measurement. This reduction is due to the absorber in the base of the air column.

The third peak is determined by scattering from the plate to the base of the column, back to the plate, and then returning to the receive horn. For the foam column, this double bounce path is the dominant scatterer. For the inflatable column, the double-bounce response occurs earlier in time and is 35 dB below the foam column result. Additional attenuation of this double bounce can be obtained by using better (taller) absorber.

Looking further downrange, multiple reflections from the base of the foam column persist for some time. This is not apparent when the inflatable column is used, resulting in a reduction of about 10 dB in ground-related clutter.

Although an inflatable column offers a means to reduce scatter from its base, backscatter from the top plug dominates backscatter from the column. Because the foam density and dielectric constant of the plug of the inflatable column are similar to those of a good quality foam column, backscatter per unit length from the plug is the same as that from a foam column.

Total backscatter from the inflatable column may be significantly less than or equal to backscatter from a foam column, depending on how much of the column is illuminated. If all of the inflatable column is illuminated, backscatter from the plug will dominate scatter from the Mylar skin. However, the length of the plug is typically less than 10% of the total length of a foam column. Hence, backscatter from a completely illuminated inflatable column would be at least 10 dB less than that from a foam column.

At some facilities only a portion of the support column is illuminated. For example, the preliminary measurements reported in this paper were obtained in an anechoic chamber with high-gain horns pointed toward a spot 2 ft above the support column. Test bodies are elevated to this spot with foam fixtures that mount to the support column. Backscatter was primarily from the test body, its foam mount, and foam from the top of the support column. Because of this mounting arrangement, the amount of foam illuminated is nearly the same for the inflatable and foam columns. Measured backscatter from the two columns was roughly equal. An improved version of the inflatable column described above would include a plug contrived to minimize backscatter without compromising structural integrity.

Because the top plug is the major source of backscatter, it is the current focus of research. Techniques to reduce its backscatter are under consideration and several candidate designs have been developed. A second area of interest is development of an inflatable support of greater load rating which is optimized for transverse and torsional rigidity.

5. SUMMARY

An inflatable support has been constructed and tested. Because this support is hollow, the inside of its base can be covered with broadband absorber to reduce reflections. Use of foam has been minimized to a short plug at the top of the column. This plug is the dominant source of backscatter. An inflatable support has attractive mechanical features. Because the plug is short compared to the length of the inflatable column, the transverse and torsional rigidity of the column is based on the mechanical properties of a pressurized thin-shell Mylar cone. Mylar is much less viscoelastic than typical foams, so variations in elastic modulus with time, temperature, and applied load are less for Mylar. Because transverse and torsional deflections are inversely proportional to the elastic modulus, the reference position of an inflatable column is better defined and can be recovered after transverse or torsional deflections. These electrical and mechanical benefits suggest that inflatable supports are beneficial to high-accuracy vector measurements.

6. ACKNOWLEDGMENTS

Initial work has been supported by Independent Research and Development funds at SRI International. An invention disclosure is in process. The authors acknowledge Gerry Andeen for his assistance in mechanical design.

7. REFERENCES

1. M.L. Wolfenbarger and P.E. Amador, "Electromagnetic and Structural Considerations in Target Support Design," AMTA Proceedings, 10th Annual Meeting and Symposium, p. 8-3, September 1988.

2. Radar Cross-Section Target Supports--Plastic Materials, RADC Center, No. TDR-64-381, AD608252, June 1964.

3. G.T. Ruck, et al., Radar Cross Section Handbook, Plenum Press, 1970, pp. 205-263.

4. C.C. Freeny, "Target Support Parameters Associated with Radar Reflectivity Measurements," Proc. IEEE, Vol. 53 p. 929, 1965.

5. W.C. Young, Roark's Formulas for Stress and Strain, 6th Ed., McGraw Hill, 1989.

6. D.G. Falconer, "Extrapolation of Near-Field RCS Measurements to the Far Zone," IEEE AP-36, no. 6, p. 822-835, June 1988.

What is claimed is:

1. An inflatable target support system comprising:

a high strength, low dielectric, stressed-skin membrane which when inflated to a predetermined pressure forms the shape of a right cone frustum, said right cone frustum having a preselected base radius and a preselected top radius, and a preselected taper angle;

a substantially rigid plug for sealing said top radius of said right cone when it is inflated, said plug having a predetermined shape including a height, a radius, and a side taper angle;

a shrinkable film which encapsulates said plug and provides a low conductance surface-contact seal between said plug and said top radius;

a chamfer base having a preselected diameter for accepting said stressed-skin membrane;

means for sealing and securing said stress-skin membrane to said chamfer base so as to provide a substantially fold-free, stable, and exceptionally rigid support for a predetermined load;

means for supplying a preselected positive pressure to said right cone to inflate it.

2. An inflatable target support system of claim 1, wherein said plug having a side taper angle which is greater than said right cone angle.

3. An inflatable target support system of claim 1, wherein said plug having a height and a radius and said plug height being approximate equal to said plug radius.

4. An inflatable target support system of claim 1, wherein said chamfer base having a preselected diameter which is greater than said right cone base radius.

* * * * *